US008526866B2

(12) United States Patent
Takiguchi

(10) Patent No.: US 8,526,866 B2
(45) Date of Patent: Sep. 3, 2013

(54) IMAGE FORMING DEVICE

(75) Inventor: Toshiki Takiguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 283 days.

(21) Appl. No.: 12/985,426

(22) Filed: Jan. 6, 2011

(65) Prior Publication Data

US 2011/0164902 A1 Jul. 7, 2011

(30) Foreign Application Priority Data

Jan. 7, 2010 (JP) ..... 2010-001916

(51) Int. Cl.
*G03G 15/01* (2006.01)

(52) U.S. Cl.
USPC ..... 399/299; 399/298; 399/300; 399/302

(58) Field of Classification Search
USPC ..... 399/298–300, 302
See application file for complete search history.

(56) References Cited

U.S. PATENT DOCUMENTS

| | | | | |
|---|---|---|---|---|
| 7,164,877 | B2 * | 1/2007 | Murakami et al. | 399/299 |
| 7,254,359 | B2 | 8/2007 | Iwakura et al. | |
| 7,715,767 | B2 * | 5/2010 | Yoshioka | 399/299 |
| 2004/0136758 | A1 * | 7/2004 | Kera et al. | 399/299 |
| 2005/0084301 | A1 | 4/2005 | Murakami et al. | |
| 2007/0071486 | A1 * | 3/2007 | Chiba et al. | 399/299 |
| 2007/0172263 | A1 | 7/2007 | Murakami et al. | |
| 2008/0003022 | A1 * | 1/2008 | Sakashita et al. | 399/303 |
| 2009/0097888 | A1 | 4/2009 | Hirai et al. | |
| 2011/0064466 | A1 * | 3/2011 | Inada | 399/299 |

FOREIGN PATENT DOCUMENTS

| | | | |
|---|---|---|---|
| CN | 1609724 | A | 4/2005 |
| JP | 2005-24936 | A | 1/2005 |
| JP | 2005-128180 | A | 5/2005 |
| JP | 2005-234229 | A | 9/2005 |
| JP | 2006-162950 | A1 | 6/2006 |
| JP | 2009-98363 | A | 5/2009 |

* cited by examiner

*Primary Examiner* — Ryan Walsh
(74) *Attorney, Agent, or Firm* — Birch, Stewart, Kolasch & Birch, LLP

(57) ABSTRACT

A transfer device of the invention includes an endless belt forming a loop-shaped path of movement passing over between a drive roller and an idle roller, a plurality of image bearing members disposed at positions along a direction of movement of the endless belt, and a plurality of transfer members disposed at positions on respective downstream sides of the plurality of image bearing members so as to oppose a plurality of respective image bearing members across the endless belt. The image bearing member disposed on the most upstream side in the direction of movement of the endless belt has a zone of contact in common with the opposed transfer member in the direction of movement of the endless belt. Whereas the other image bearing members do not have any zone of contact in common with the opposing respective transfer members in the direction of movement of the endless belt.

5 Claims, 8 Drawing Sheets

FIG.5

| | | type | area of failure in picture quality | | | |
|---|---|---|---|---|---|---|
| | | | color Y | color C | color M | color BK |
| offset value F (mm) | 0.0 | contact | × | × | × | × |
| | 0.5 | contact | ○ | × | × | × |
| | 1.0 | contact | ◎ | × | × | × |
| | 1.5 | contact | ○ | × | × | × |
| | 2.0 | non-contact | ○ | ○ | ○ | ○ |
| | 2.5 | non-contact | ○ | ◎ | ◎ | ◎ |
| | 3.0 | non-contact | ○ | ○ | ○ | ○ |
| | 3.5 | non-contact | ○ | ○ | ○ | ○ |
| | 4.0 | non-contact | ○ | ○ | ○ | ○ |

IMAGE FORMING DEVICE

CROSS REFERENCE

This Nonprovisional application claims priority under 35 U.S.C. §119(a) on Patent Application No. 2010-001916 filed in Japan on Jan. 7, 2010 the entire contents of which are hereby incorporated by reference.

BACKGROUND OF THE INVENTION

The present invention relates to a tandem-type transfer device that is provided with a plurality of photoreceptor drums for respective hues and transcribes toner images formed on the respective photoreceptor drums to an intermediate transfer belt.

In conventional tandem systems, transfer of the toner images on the respective photoreceptor drums to the intermediate transfer belt has been carried out by applying a transfer bias to each of the photoreceptor drums (for instance, refer to Japanese Patent Unexamined Publication No. 2005-234229 bulletin).

In conventional image forming apparatus, the photoreceptor drums and the plurality of intermediate transfer rollers have been disposed at such positions that contact is made between each of the photoreceptor drums and each of the intermediate transfer rollers sandwiching the intermediate transfer belt in between, and then each of the intermediate transfer rollers to which a transfer bias is applied causes the intermediate transfer belt to contact with pressure each of the photoreceptor drums. In this case, because each of the photoreceptor drums has a zone of contact in common with the opposed intermediate transfer roller in the direction of movement of the intermediate transfer belt, it is likely that, depending on a nip pressure to each of the photoreceptor drums, missing characters or the like occurs due to toner aggregation, thus resulting in deficiencies in picture quality.

To overcome this problem, for example, as shown in FIG. 6, in the transfer device of the Japanese Patent Unexamined Publication No. 2005-234229 bulletin, photoreceptor drums 31A-31D are disposed in the order of the photoreceptor drum 31D, the photoreceptor drum 31C, the photoreceptor drum 31B and the photoreceptor drum 31A from the upstream side toward the downstream side along a direction of movement C of the intermediate transfer belt. And, in the transfer device, the photoreceptor drums 31A-31D have a zone of contact in common with the opposed intermediate transfer rollers 34A-34D in the direction of movement of the intermediate transfer belt 41 respectively. Then, a transfer bias is applied from each of the intermediate transfer rollers 34A-34D to each of the photoreceptor drums 31A-31D through the intermediate transfer belt 41. In this case, assuming that a direction of rotating shafts of the respective photoreceptor drums 31A-31D is arranged in a horizontal direction, because the bottom of an idle roller 43 is located above the tops of the photoreceptor drums 31A-31D, and since the intermediate transfer belt 41 is stretched obliquely onto the photoreceptor drum 31D of the most upstream side from an upper direction toward a lower direction, a nip pressure to the photoreceptor drum 31D of the most upstream side is not stable. As a result, transfer failure occurs at the photoreceptor drum 31D of the most upstream side.

Then, in the transfer device of the Japanese Patent Unexamined Publication No. 2005-234229 bulletin, occurrence of the transfer failure has been overcome by controlling the nip pressure(s) to the respective photoreceptor drums 31A-31D; even so, controlling the nip pressure or pressures is a complicated process.

Also, as shown in FIG. 7, when a distance in horizontal direction is increased between the compliance roller 43 and the photoreceptor drum 31D of the most upstream side while a distance in vertical direction is fixed between the bottom of the compliance roller 43 and the tops of the photoreceptor drums 31A-31D, an entry angle of the intermediate transfer belt 41 to the photoreceptor drum 31D of the most upstream side decreases (is lowered). In this manner, when the entry angle of the intermediate transfer belt 41 is decreased (lowered), the occurrence of transfer failure of the photoreceptor drum 31D of the most upstream side is overcome. Nevertheless, it follows from this that the device upsizes as much as the distance in horizontal direction is increased between the photoreceptor drum 31D of the most upstream side and the compliance roller 43.

Further, as shown in FIG. 8, when a supplementary roller 44 is provided separately on the upstream side of the photoreceptor drum 31D of the most upstream side, the intermediate transfer belt 41 is depressed by the supplementary roller 44 to the photoreceptor drum 31D side. In this manner, by decreasing (lowering) the entry angle of the intermediate transfer belt 41 to the photoreceptor drum 31D of the most upstream side, the occurrence of transfer failure of the photoreceptor drum 31D of the most upstream side is overcome. However, it follows from this that the supplementary roller 44 and a lifting means to move the supplementary roller 44, etc. become necessary separately, thus resulting in an increased number of parts, and that the device upsizes because an area for housing the lifting means becomes necessary.

Thus, the present invention is directed to providing a transfer device capable of decreasing the occurrence of deficiencies in picture quality while realizing downsizing thereof.

SUMMARY OF THE INVENTION

A transfer device according to the present invention comprises an endless belt forming a loop-shaped path of movement passing over between a drive roller and an idle roller; a plurality of image bearing members disposed at positions along a direction of movement of the endless belt; and a plurality of transfer members (for example, intermediate transfer rollers, brush-shaped intermediate transfer members or the like) disposed at positions on respective downstream sides of the plurality of image bearing members so as to oppose the plurality of respective image bearing members sandwiching the endless belt in between. The image bearing member disposed on the most upstream side in the direction of movement of the endless belt has a zone of contact that is in common with the opposed transfer member in the direction of movement of the endless belt. Whereas the other image bearing members do not have any zone of contact in common with the opposed respective transfer members in the direction of movement of the endless belt.

Thereby, assuming that a direction of rotating shafts of the plurality of image bearing members is arranged in a horizontal direction, even if the endless belt is stretched obliquely onto the image bearing member disposed on the most upstream side from an upper direction toward a lower direction, because the image bearing member disposed on the most upstream side and the opposed transfer member have the common zone of contact in the direction of movement of the endless belt, a nip pressure between the image bearing member disposed on the most upstream side and the endless belt can be rendered stable; thus the transfer failure can be prevented. Besides, since the other image bearing members and the opposed respective transfer members do not have any common zone of contact in the direction of movement of the endless belt, nip pressures between the other image bearing members and the endless belt can be lowered; thus the occurrence of missing characters due to toner aggregation or the like can be prevented. As a consequence, decreasing the occurrence of deficiencies in picture quality can be realized while downsizing the device.

It is preferred to configure in such a manner that a hue of which image is formed by the image bearing member disposed on the most upstream side is the hue with which the transfer failure is most inconspicuous. Since the image bearing member disposed on the most upstream side has the zone of contact that is in common with the opposed transfer member in the direction of movement of the endless belt, the nip pressure thereof is incapable of being lowered; thereby missing characters due to toner aggregation, etc. occurs; and it is where the possibility that the transfer failure occurs is the highest. Therefore, by disposing the image bearing member with which hue the transfer failure is most inconspicuous on the most upstream side, it is enabled that the transfer failure is most inconspicuous even when it has occurred.

It is preferred to configure in such a manner that the hue of which image is formed by the image bearing member disposed on the most upstream side is yellow. For example, when a toner consisting of four-colored (yellow, magenta, cyan and black) hues is used, it is enabled that the transfer failure is most inconspicuous even when it has occurred.

It is preferred to configure in such a manner that a hue of the image bearing member disposed on the most downstream side is black, and that a transfer member shifting mechanism for moving the plurality of transfer members close to and away from the plurality of image bearing members is provided. In this case, upon color printing, the plurality of transfer members are caused to come close to the plurality of respective image bearing members; whereas upon monochromatic printing, only the transfer member disposed on the most downstream side is caused to come close to the opposed image bearing member while the other transfer members are caused to come away from the opposed image bearing members.

Consequently, the occurrence of deficiencies in picture quality can be reduced in color printing. Additionally, in monochromatic printing, by disposing the image bearing member used therefor on the most downstream side, distance in horizontal direction can be separated most from either the drive roller or the compliance roller between both of which the endless belt is stretched, whichever is disposed on the upstream side; thus, an entry angle of the endless belt to the image bearing member can be decreased (lowered) most. Thereby, the nip pressure between the image bearing member and the endless belt is rendered stable, so that missing characters due to toner transfer void does not occur; hence the transfer failure does not occur.

With the transfer device according to the present invention, decreasing the occurrence of deficiencies in picture quality while downsizing the device can be realized.

BRIEF DESCRIPTION OF THE DRAWINGS

FIG. 5 is a table showing an example of offset values.

DETAILED DESCRIPTION OF THE INVENTION

Figure 1:
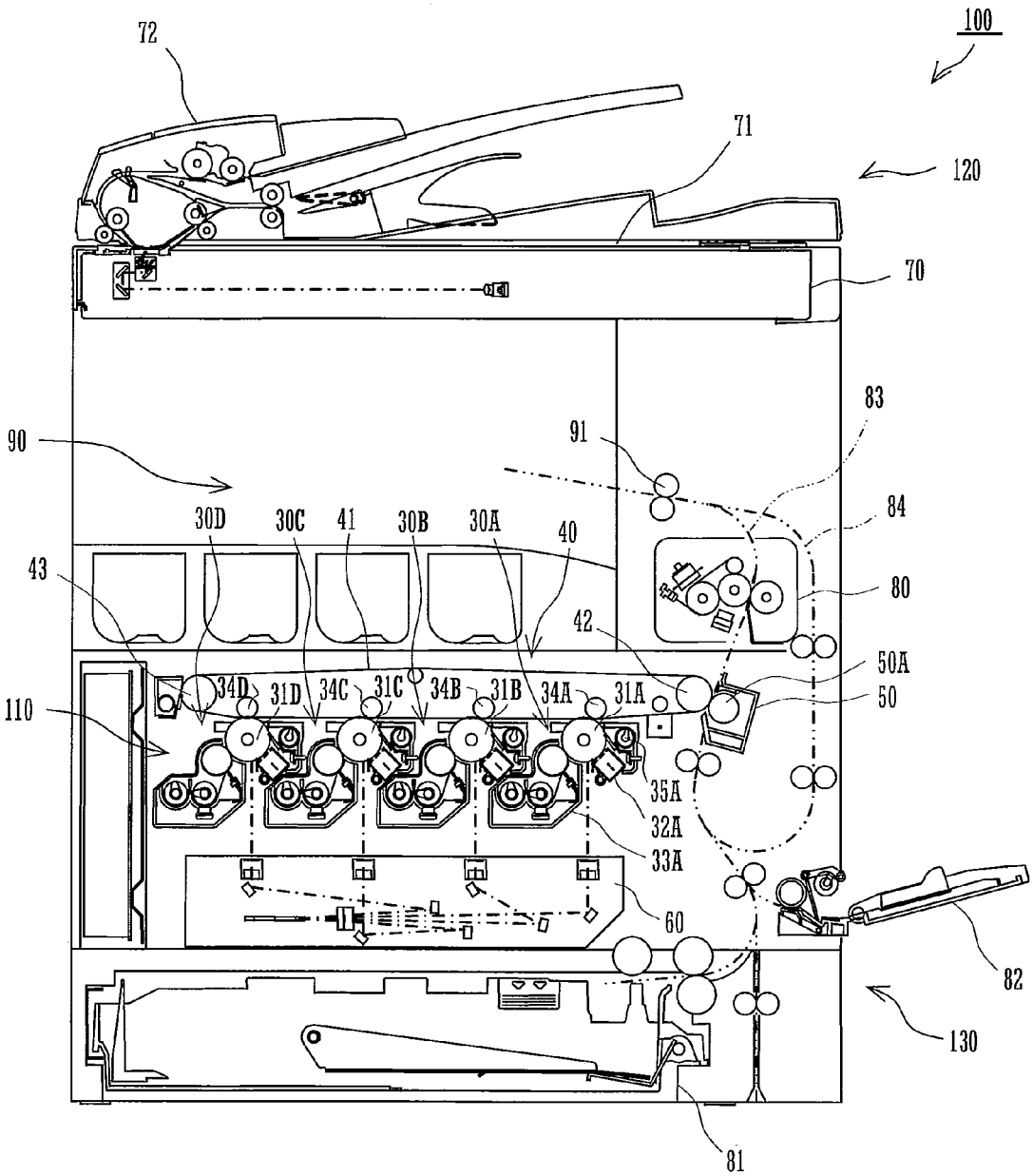
FIG. 1 is a schematic front sectional view of an image forming apparatus comprising a transfer device according to the present invention.

An image forming apparatus comprising a transfer device according to an embodiment of the present invention is explained below referring to the drawings.

FIG. 1 is a schematic front sectional view of an image forming apparatus comprising a transfer device according to the present invention. The image forming apparatus 100 forms a multicolored or a monochromatic image onto a predetermined sheet of paper (recording medium) based on image data that have been read from a document. For this purpose, the image forming apparatus 100 is equipped with an image reading device 120 in the upper part of its main body, and is provided with an image forming section 110 (corresponding to a transfer device of the present invention) and a paper supply section 130 inside the main body.

The image reading device 120 includes a scanner unit 70, a document table 71, and an automated document feeder 72. The scanner unit 70 reads data for printing from an image plane of the document placed on a top surface of the document table 71 at the time of copying operation. The document table 71 is made of rigid sheet glass, and is attached to the top surface of the main body of the image forming apparatus 100. The top surface of the document table 71 is configured so as to be freely opened and shut by the automated document feeder 72. The automated document feeder 72 conveys documents placed on a document load tray to a paper discharge tray piece by piece. In so doing, the scanner unit 70 reads the data for printing from the image plane of the document.

The image forming section 110 is provided with an intermediate transfer belt unit 40, a first to a fourth image forming stations 30A-30D, a secondary transfer unit 50, an exposure unit 60 and a fuser unit 80. The intermediate transfer belt unit 40 stretches an intermediate transfer belt 41, which is an endless belt (corresponding to an endless belt of the present invention), in a freely rotatable manner and in a tensioned condition by a drive roller 42 and an idle roller 43, etc. The intermediate transfer belt 41 is made using a film of about 60 μm-150 μm thick.

The first to fourth image forming stations 30A-30D respectively perform image forming processes according to a method of electrophotography using developers of respective colors consisting of black, cyan, magenta and yellow. For instance, in the first image forming station 30A, an electrifier 32A, a developing device 33A, an intermediate transfer roller 34A and a cleaning device 35A are disposed around a photoreceptor drum 31A (corresponding to an image bearing member of the present invention).

The intermediate transfer roller 34A is formed from a shaft made of metal (e.g., stainless steel) with a diameter of 8-10 mm of which surface is covered by an electrically-conductive elastomer (e.g., EPDM, urethane foam or the like), and applies a high voltage uniformly to the intermediate transfer belt 41 through the electrically-conductive elastomer. The intermediate transfer roller 34A is urged against the photoreceptor drum 31A to a direction that is different from the direction normal to the photoreceptor drum 31A. Here, instead of the intermediate transfer roller 34A, a brush-shaped intermediate transfer member may be used.

The second to fourth image forming stations 30B-30D are configured in the same manner as the first image forming station 30A. The first to fourth image forming stations 30A-30D are arranged in a single row in a direction of movement (secondary scanning direction) of the intermediate transfer belt 41.

The exposure unit 60 drives semiconductor lasers based on the image data on the respective colors consisting of black, cyan, magenta and yellow that have been read by the image scanner 120, and distributes laser beams of the respective colors to the first to fourth image forming stations 30A-30D. The exposure unit 60 may be the one utilizing a light source other than the semiconductor laser, e.g., such as a light emitting diode array that is driven based on the image data.

For example, at the first image forming station 30A, a circumferential surface of the photoreceptor drum 31A, after having been charged with electricity uniformly by the electrifier 32A, is exposed by the laser beam that is distributed from the exposure unit 60 based on the image data on black. Thereby, an electrostatic latent image is formed on the circumferential surface of the photoreceptor drum 31A based on the image data on black. Subsequently, a black developer is supplied from a developing device 33A to the circumferential surface of the photoreceptor drum 31A, and there the electrostatic latent image is rendered visible in a black toner image. The toner image formed on the circumferential surface of the photoreceptor drum 31A is transcribed onto the surface of the intermediate transfer belt 41 by the intermediate transfer roller 34A to which a primary transfer bias of reverse polarity (+) to the electrostatic charge polarity (−) of the toner is applied. The toner remaining on the surface of the photoreceptor drum 31A is removed by the cleaning device 35A.

In monochromatic image forming, the aforementioned process is carried out only at the first image forming station 30A. Additionally, in color image forming, the processes similar to that at the first image forming station 30A are also carried out as to the respective colors of cyan, magenta and yellow at the second to fourth image forming stations 30B-30D. The toner images of the respective colors consisting of black, cyan, magenta and yellow are superimposed on the surface of the intermediate transfer belt 41.

The paper supply section 130 is provided with a paper cassette 81, a hand-fed paper tray 82, a main paper conveying path 83, and a secondary paper conveying path 84. In the paper cassette 81, a plurality of sheets of paper of a size and kind with a relatively high frequency in use are received. On the hand-fed paper tray 82, a sheet of paper of a size and kind with a relatively low frequency in use is placed.

The main paper conveying path 83 is formed extending from the paper cassette 81 and the hand-fed paper tray 82 to the paper discharge section 90 by way of an interstice between the intermediate transfer belt 41 and the secondary transfer unit 50, and then via the fuser unit 80. The secondary transfer unit 50, comprising a transfer roller 50A, transcribes onto paper the toner image borne on the surface of the intermediate transfer belt 41 by means of the transfer roller 50A to which a secondary transfer bias of reverse polarity (+) to the electrostatic charge polarity (−) of the toner is applied. The fuser unit 80 applies heat and pressure to the paper on which the toner image has been transcribed, and thus fixes the toner image on the paper.

Further, in order to maintain a nip pressure between the transfer roller 50A of the secondary transfer unit 50 and the intermediate transfer belt 41 at a predetermined value, either of the transfer roller 50A or the drive roller 42 is made of a rigid material (metal, etc.), then to the other is employed an elastic roller made of a flexible material or the like (elastic rubber roller or foam resin roller, etc.).

The secondary paper conveying path 84 is formed, in terms of the main paper conveying path 83, extending from a section between a passage point of the fuser unit 80 and a point at which the paper discharge roller 91 is disposed, to the upstream side of a point at which the secondary transfer unit 50 is disposed. In the case of double-sided image forming on paper, the secondary paper conveying path 84 conveys the paper, which has been caused to reverse back and front edges thereof by the paper discharge roller 91 after it passed the fuser unit 80 subsequently after an image had been formed on the first face thereof, to the interstice between the intermediate transfer belt 41 and the transfer roller 50A of the secondary transfer unit 50.

Subsequently, referring to FIG. 2A-FIG. 4, a relationship in an arrangement of the photoreceptor drums 31A-31D and the intermediate transfer rollers 34A-34D in the image forming section 110 is explained.

Figure 2A:
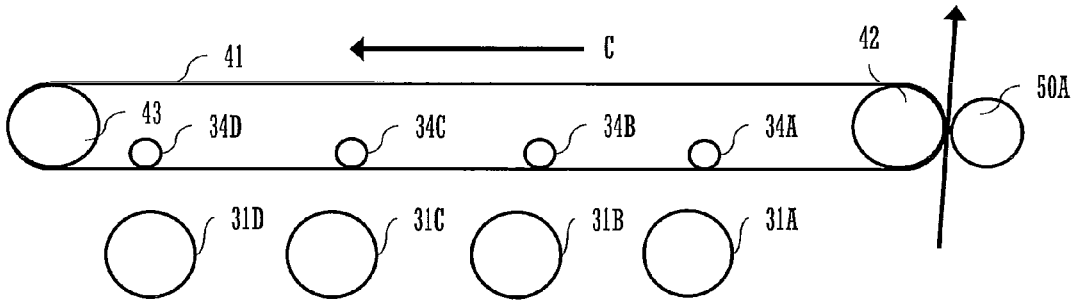
FIG. 2A is a drawing showing a relationship in an arrangement of image bearing members and intermediate transfer rollers of the transfer device at the time when image is not formed.

As shown in FIG. 2A, the intermediate transfer belt 41 is stretched in a tensioned condition between the drive roller 42 and the compliance roller 43, forming a loop-shaped path of movement. To an outer circumferential surface of the intermediate transfer belt 41 are disposed the photoreceptor drums 31A-31D in the order of the photoreceptor drum 31D, the photoreceptor drum 31C, the photoreceptor drum 31B and the photoreceptor drum 31A along the direction of movement C of the intermediate transfer belt. At positions opposite the respective photoreceptor drums 31A-31D, the intermediate transfer rollers 34A-34D are disposed sandwiching the intermediate transfer belt 41 in between.

Additionally, assuming that the direction of movement C of the intermediate transfer belt 41 is a horizontal direction at the time when image is not formed (refer to FIG. 2A), bottoms of the drive roller 42 and the compliance roller 43 and the bottoms of the intermediate transfer rollers 34A-34D are disposed in a straight line. Bottoms of the drive roller 42 and the compliance roller 43 are disposed above tops of the photoreceptor drums 31A-31D.

The intermediate transfer rollers 34A-34D are rendered movable by an elevator mechanism (transfer member shifting mechanism), which is not illustrated, toward a direction (vertically oriented) that is perpendicular to the direction of movement C (horizontally oriented) of the intermediate transfer belt 41 at the time when image is not formed, and thereby coming close to the opposed respective photoreceptor drums 31A-31D, or away from the photoreceptor drums 31A-

31D. That is to say, the intermediate transfer rollers 34A-34D, by means of the elevator mechanism, causes the intermediate transfer belt 41 to contact the photoreceptor drums 31A-31D with pressure, or causes the intermediate transfer belt 41 to come away from the drums 31A-31D. Also, rotating shafts of the intermediate transfer rollers 34A-34D are disposed at positions on respective downstream sides of rotating shafts of the opposed respective photoreceptor drums 31A-31D in the direction of movement C of the intermediate transfer belt 41.

At the time when image is not formed as shown in FIG. 2A, the intermediate transfer rollers 34A-34D cause the intermediate transfer belt 41 to come away from the photoreceptor drums 31A-31D. That is, at the time when image is not formed, the direction of movement C of the intermediate transfer belt 41, the direction of arrangement of the rotating shafts of the photoreceptor drums 31A-31D, and the direction of arrangement of the rotating shafts of the intermediate transfer rollers 34A-34D are rendered parallel.

Figure 2B:
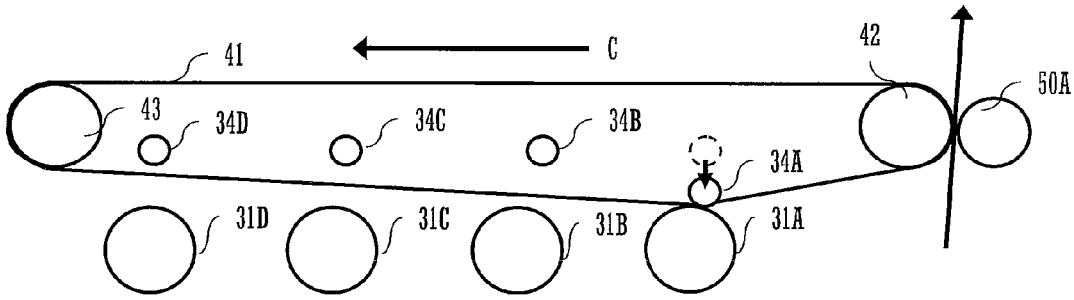
FIG. 2B is a drawing showing a relationship in an arrangement of the image bearing members and the intermediate transfer rollers of the transfer device at the time when a monochromatic image is formed.

At the time when a monochromatic image is formed as shown in FIG. 2B, the intermediate transfer roller 34A causes the intermediate transfer belt 41 to contact the photoreceptor drum 31A with pressure; whereas the intermediate transfer rollers 34B-34D cause the intermediate transfer belt 41 to come away from the photoreceptor drums 31B-31D. In this case, the intermediate transfer belt 41 stretches obliquely onto the photoreceptor drum 31A from an upper direction toward a lower direction; even so, because the distance in the horizontal direction between the compliance roller 43 and the photoreceptor drum 31A is far apart, an entry angle of the intermediate transfer belt 41 to the photoreceptor drum 31A is small (low). As a result, a nip pressure between the photoreceptor drum 31A and the intermediate transfer belt 41 is rendered stable, and also transfer can be performed with a low nip pressure between the photoreceptor drum 31A and the intermediate transfer belt 41. Accordingly, the occurrence of missing characters due to toner aggregation on the intermediate transfer belt 41 or the like is prevented; hence a satisfactory result can be attained in image forming in the secondary transfer step.

Further, in monochromatic image forming, by means of a primary transfer bias being applied to the intermediate transfer roller 34A, a primary transfer of the toner image is performed from the photoreceptor drum 31A to the intermediate transfer belt 41 that is moving toward the direction of movement C. Then, by means of a secondary transfer bias being applied to the transfer roller 50A when the paper conveyed passes between the drive roller 42 and the transfer roller 50A, a secondary transfer of the toner image is performed from the intermediate transfer belt 41 to the paper.

Figure 2C:
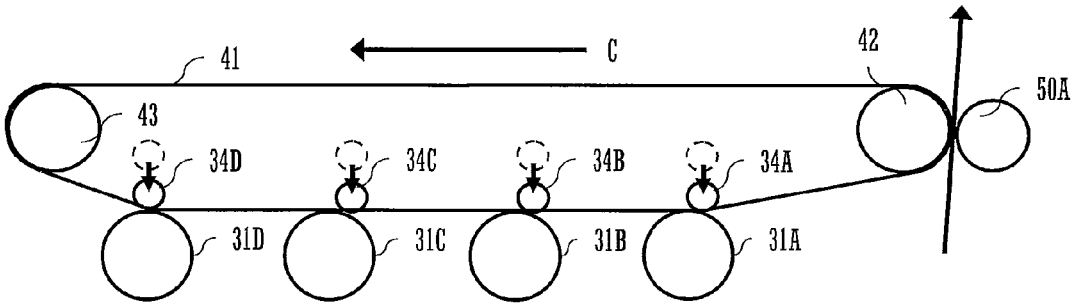
FIG. 2C is a drawing showing a relationship in an arrangement of the image bearing members and the intermediate transfer rollers of the transfer device at the time when a color image is formed.

At the time when a color image is formed as shown in FIG. 2C, the intermediate transfer rollers 34A-34D cause the intermediate transfer belt 41 to contact the photoreceptor drums 31A-31D with pressure.

Figure 3:
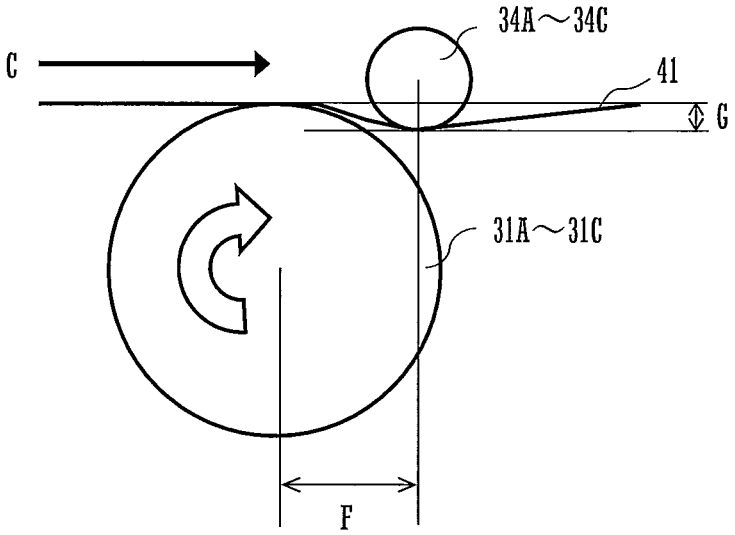
FIG. 3 is a drawing showing a relationship in an arrangement of an image bearing member other than the one of the most upstream side.

In this case, as shown in FIG. 3, the photoreceptor drum 31A does not possess a zone of contact that is in common with the intermediate transfer roller 34A in the direction of movement C of the intermediate transfer belt 41, but possesses a zone at which only the intermediate transfer belt 41 intervenes in between. That is, the photoreceptor drum 31A is caused to contact the intermediate transfer belt 41 with pressure indirectly by the intermediate transfer roller 34A. As a result, because the photoreceptor drum 31A is capable of performing a transfer process with a lowered nip pressure against the intermediate transfer belt 41, the occurrence of missing characters due to toner aggregation on the intermediate transfer belt 41 or the like is prevented; and thus a satisfactory result can be attained in image forming in the secondary transfer step.

Besides, the photoreceptor drums 31B, 31C, in the same manner as the photoreceptor drum 31A, do not possess a zone of contact in common with the intermediate transfer rollers 34B, 34C respectively in the direction of movement C of the intermediate transfer belt 41, either. Therefore, also as to the photoreceptor drums 31B, 31C, in the same manner as the photoreceptor drum 31A, the occurrence of missing characters due to toner aggregation on the intermediate transfer belt 41, etc. is prevented; hence a satisfactory result can be attained in image forming in the secondary transfer step.

Figure 4:
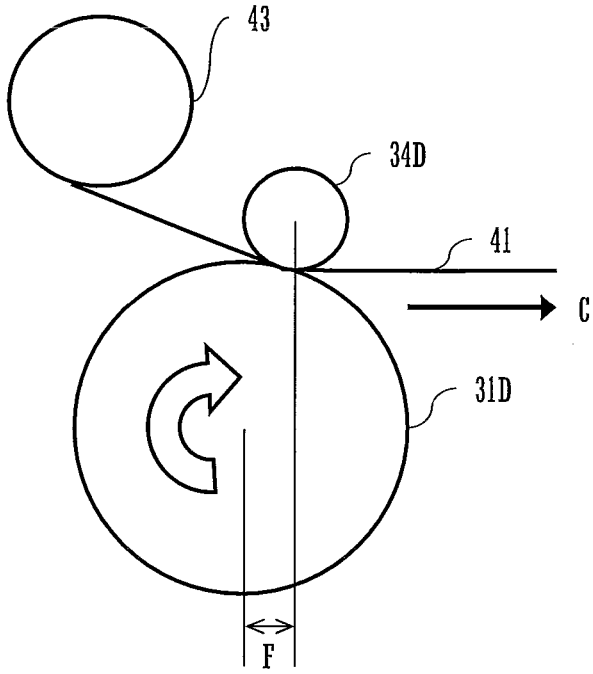
FIG. 4 is a drawing showing a relationship in an arrangement of the image bearing member of the most upstream side.
Figure 6:
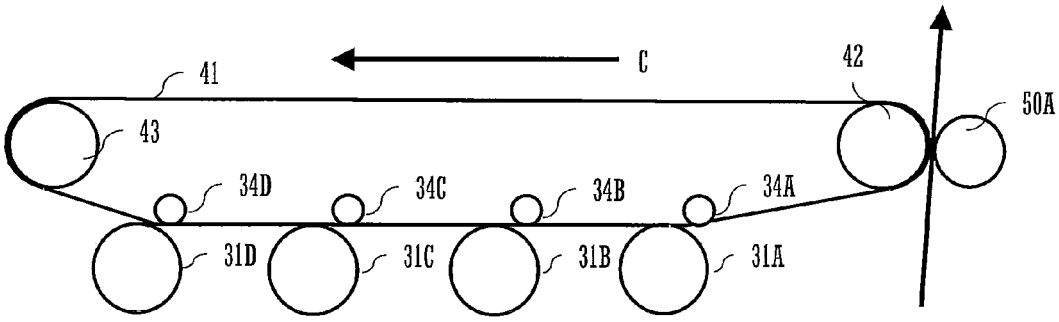
FIG.6 RELATED ART
FIG. 6 is a drawing showing a relationship in an arrangement of image bearing members and intermediate transfer rollers of a conventional transfer device.
Figure 7:
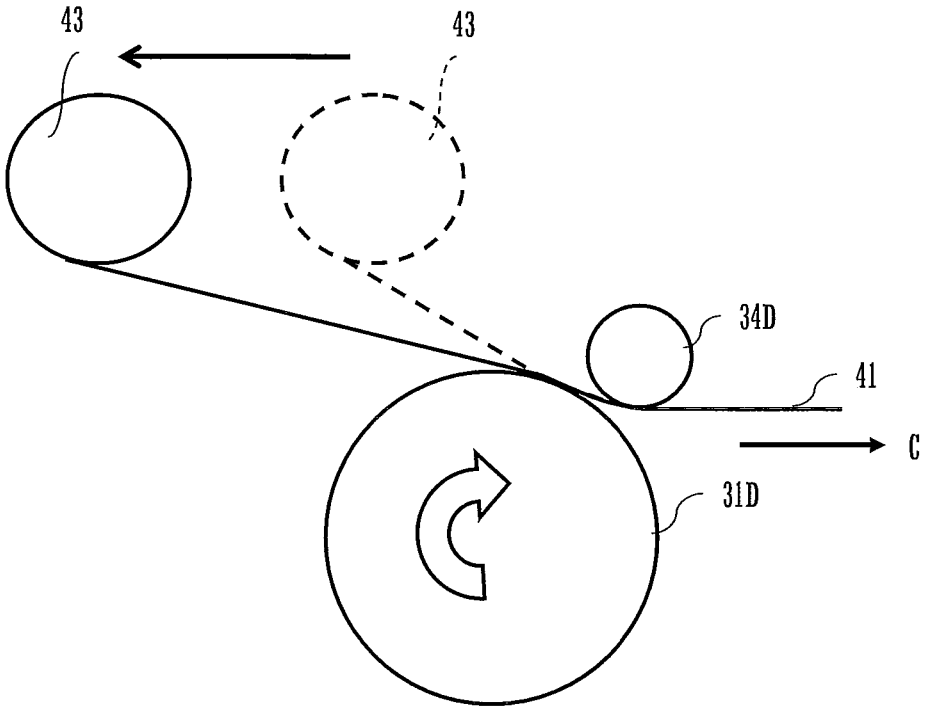
FIG.7 RELATED ART
FIG. 7 is a drawing showing a relationship in an arrangement of the conventional image bearing member of the most upstream side.
Figure 8:
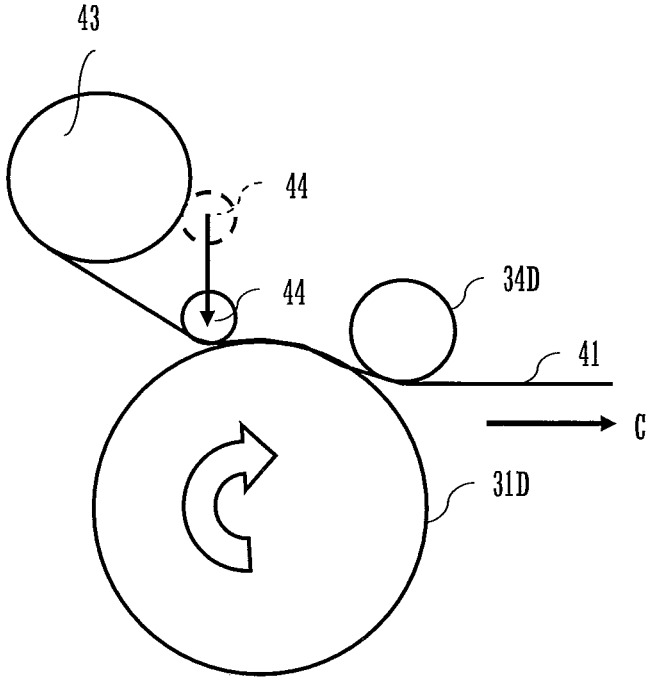
FIG.8 RELATED ART
FIG. 8 is a drawing showing a relationship in another arrangement of the conventional image bearing member of the most upstream side.

Moreover, as shown in FIG. 4, the photoreceptor drum 31D disposed on the most upstream side possesses a zone of contact that is in common with the intermediate transfer roller 34D in the direction of movement C of the intermediate transfer belt 41. That is, the photoreceptor drum 31D is caused to contact the intermediate transfer belt 41 with pressure directly by the intermediate transfer roller 34D. Normally, at the position where the photoreceptor drum 31D is disposed on the most upstream side, the intermediate transfer belt 41 stretches thereto obliquely from an upper direction toward a lower direction while the distance in the horizontal direction to the compliance roller 43 is small; so that an entry angle of the intermediate transfer belt 41 is large (high), causing the intermediate transfer belt 41 to have a steep gradient. As a result, a nip pressure between the photoreceptor drum 31D and the intermediate transfer belt 41 is rendered unstable. Even so, because the photoreceptor drum 31D is caused to contact the intermediate transfer belt 41 with pressure directly by the intermediate transfer roller 34D, the nip pressure against the intermediate transfer belt 41 can be stabilized; therefore, missing characters due to toner transfer void does not occur, so that the transfer failure can be prevented.

Here, because the photoreceptor drum 31D is caused to contact the intermediate transfer belt 41 with pressure directly, missing characters due to toner aggregation is likely to occur. Nonetheless, since a developer of a hue (yellow) with which missing characters or the like is inconspicuous is supplied to the photoreceptor drum 31D, the transfer failure is not conspicuous in image forming in the secondary transfer step.

Further, in color image forming, by means of a primary transfer bias being applied to the intermediate transfer rollers 34A-34D, a primary transfer of the toner images is performed in passing order of the photoreceptor drums 31A-31D from the photoreceptor drums 31A-31D to the intermediate transfer belt 41 that is moving toward the direction of movement C. Then, by means of a secondary transfer bias that is applied to the transfer roller 50A when the paper conveyed passes the interstice between the drive roller 42 and the transfer roller 50A, a secondary transfer of the toner images is performed from the intermediate transfer belt 41 to the paper.

Consequently, the image forming section 110 is capable of decreasing the occurrence of deficiencies in picture quality without increasing a number of parts, and thus advantageous in terms of cost. Besides, the image forming section 110 does not necessitate widening the distance between each part, hence allows downsizing an apparatus.

Subsequently, referring to FIG. 3-FIG. 5, a relationship in an arrangement of the photoreceptor drums 31A-31D and the intermediate transfer rollers 34A-34D is explained based on a result of visual inspection of picture quality. In the inspection, it was recognized that the diameters of the photoreceptor drums 31A-31D, the intermediate transfer rollers 34A-34D and the shafts were 30 mm, 12 mm and 8 mm, respectively. In the table of FIG. 5, inspected picture quality is shown by the marks ◎, ○ and X, indicating very satisfactory, almost satisfactory and failure, respectively.

First, a relationship in the arrangement of the photoreceptor drums 31A-31C and the intermediate transfer rollers 34A-34C is explained illustrating the photoreceptor drum 31A and the intermediate transfer roller 34A as an example.

As shown in FIG. 3, the intermediate transfer roller 34A is fixed (locked) at such a position that the intermediate transfer belt 41 is depressed to the photoreceptor drum 31A side to the amount of a push down value G (1 mm). At this stage, the intermediate transfer roller 34A is fixed (locked) in such a manner that its bearing section (not shown) is brought in contact with a holder member (not shown) holding the photoreceptor drum 31A.

In this case, whether the picture quality is good or bad depends on a distance (offset value F) between a rotating shaft of the photoreceptor drum 31A and the rotating shaft of the intermediate transfer roller 34A in the direction of movement C of the intermediate transfer belt 41. As shown in FIG. 5, when the offset value F is 2.0 mm-4.0 mm, the photoreceptor drum 31A does not have a zone of contact in common with the intermediate transfer roller 34A in the direction of movement C of the intermediate transfer belt 41. Notably, when the offset value F is 3.0 mm, the occurrence of missing characters due to toner aggregation or the like on the intermediate transfer belt 41 can be prevented most. A relationship in the arrangement of the remaining photoreceptor drums 31B, 31C and intermediate transfer rollers 34B, 34C is similar to the above.

Next, a relationship in the arrangement of the photoreceptor drum 31D disposed on the most upstream side and the intermediate transfer roller 34D is explained. As shown in FIG. 4, the intermediate transfer roller 34D is fixed (locked) at a position so as to abut against the intermediate transfer belt 41. At this stage, the intermediate transfer roller 34D is fixed (locked) in such a manner that its bearing section (not shown) is brought in contact with a holder member (not shown) holding the photoreceptor drum 31D.

In this case, whether the picture quality is good or bad depends on a distance (offset value F) between a rotating shaft of the photoreceptor drum 31D and the rotating shaft of the intermediate transfer roller 34D in the direction of movement C of the intermediate transfer belt 41. As shown in FIG. 5, when the offset value F is 0.5 mm-1.5 mm, the photoreceptor drum 31D has a zone of contact that is in common with the intermediate transfer roller 34D in the direction of movement C of the intermediate transfer belt 41. Notably, when the offset value F is 1.0 mm, the occurrence of missing characters due to toner aggregation or the like on the intermediate transfer belt 41 can is be prevented most. On the other hand, when the offset value F is 0.0 mm, transfer irregularity occurs due to excessive charge, causing a failure in picture quality.

In addition, in the above described embodiment, the rotating shafts of the intermediate transfer rollers 34A-34D have been disposed at positions of the respective downstream sides of the rotating shafts of the opposed respective photoreceptor drums 31A-31D in the direction of movement C of the intermediate transfer belt 41. However, the rotating shafts of the intermediate transfer rollers 34A-34D may be disposed at positions of the respective upstream sides of the rotating shafts of the opposed respective photoreceptor drums 31A-31D in the direction of movement C of the intermediate transfer belt 41. Nevertheless, if the intermediate transfer rollers 34A-34D are disposed on the respective upstream sides of the photoreceptor drums 31A-31D, there is a possibility that scattering of toner images may occur. Therefore it is preferred to dispose the intermediate transfer rollers 34A-34D on the respective downstream sides of the photoreceptor drums 31A-31D, because therewith charges are applied onto the images on the photoreceptor drums 34A-34D after the nip pressure is generated; and then a satisfactory image transfer can be performed.

Further, although a toner consisting of four-colored hues has been used in the above described embodiment, other toners consisting of multi-colored hues such as six-colored or eight-colored hues may be used. In this case, it is recommended that the photoreceptor drum bearing a developer with which hue the transfer failure is most inconspicuous is disposed on the most upstream side.

Further still, in the above described embodiment, the intermediate transfer rollers 34A-34D have been caused to be movable by the transfer member shifting mechanism (not shown) toward the direction perpendicular to the direction of movement C of the intermediate transfer belt 41. However, the movable direction is not limited as such; instead, any other direction may be acceptable provided that the intermediate transfer rollers 34A-34D are caused to be disposed at positions identical to those described above at the time of their contacting the intermediate transfer belt with pressure.

The above explanation of the embodiment is nothing more than illustrative in any respect, nor should be thought of as restrictive. Scope of the present invention is indicated by claims rather than the above embodiment. Further, it is intended that all changes that are equivalent to a claim in the sense and realm of the doctrine of equivalence be included within the scope of the present invention.

What is claimed is:

1. An image forming device comprising:

an endless belt forming a loop-shaped path of movement passing over between a drive roller and an idle roller that are fixed at positions in the device;

a plurality of image bearing members disposed side by side within predetermined limits along a direction of movement of the endless belt, each of the plurality of image bearing members bearing a toner image of a different hue; and a plurality of transfer members disposed on an inner side of the path of movement at positions of respective downstream sides of the plurality of image bearing members in the direction of movement so as to oppose the plurality of respective image bearing members sandwiching a part of the endless belt in between, each of the plurality of transfer members transferring onto the endless belt a toner image borne on each of the plurality of image bearing members, wherein:

a position in which the image bearing member disposed on the most upstream side in the direction of movement of the endless belt contacts the endless belt coincides, in the direction of movement of the endless belt, with a position in which the opposed transfer member contacts the endless belt, whereas a position in which each of the other image bearing members contacts the endless belt is offset, in the direction of movement of the endless belt, from a position in which the opposing respective transfer member contacts the endless belt; and a hue of a toner image borne on the image bearing member disposed on the most upstream side in the direction of movement is yellow.

2. The image forming device as claimed in claim 1 wherein a hue of a toner image borne on the image bearing member disposed on the most downstream side in the direction of movement is black; further comprising a transfer member shifting mechanism that causes the plurality of respective transfer members to come close to and away from the plurality of respective image bearing members, wherein in color printing, the transfer member shifting mechanism causes the plurality of respective transfer members to come close to the plurality of respective image bearing members; and in monochromatic printing, the transfer member shifting mechanism causes the transfer member disposed on the most downstream side to come close to the opposed image bearing member, and causes the other transfer members to come away from the opposed image bearing members.

3. The image forming device as claimed in claim 1 wherein a hue of a toner image borne on the image bearing member disposed on the most downstream side in the direction of movement is black; further comprising a transfer member shifting mechanism that causes the plurality of respective transfer members to come close to and away from the plurality of respective image bearing members, wherein in color printing, the transfer member shifting mechanism causes the plurality of respective transfer members to come close to the plurality of respective image bearing members; and in monochromatic printing, the transfer member shifting mechanism causes the transfer member disposed on the most downstream side to come close to the opposed image bearing member, and causes the other transfer members to come away from the opposed image bearing members.

4. An image forming device comprising:

an endless belt forming a loop-shaped path of movement passing over between a drive roller and an idle roller that are fixed at positions in the device;

a plurality of image bearing members disposed side by side within predetermined limits along a direction of movement of the endless belt, each of the plurality of image bearing members bearing a toner image of a different hue; and a plurality of transfer members disposed on an inner side of the path of movement at positions of respective downstream sides of the plurality of image bearing members in the direction of movement so as to oppose the plurality of respective image bearing members sandwiching a part of the endless belt in between, each of the plurality of transfer members transferring onto the endless belt a toner image borne on each of the plurality of image bearing members wherein:

a position in which the image bearing member disposed on the most upstream side in the direction of movement of the endless belt contacts the endless belt coincides, in the direction of movement of the endless belt, with a position in which the opposed transfer member contacts the endless belt, whereas a position in which each of the other image bearing members contacts the endless belt is offset, in the direction of movement of the endless belt, from a position in which the opposing respective transfer member contacts the endless belt; and a hue of a toner image borne on the image bearing member disposed on the most downstream side in the direction of movement is black; further comprising a transfer member shifting mechanism that causes the plurality of respective transfer members to come close to and away from the plurality of respective image bearing members, wherein in color printing, the transfer member shifting mechanism causes the plurality of respective transfer members to come close to the plurality of respective image bearing members; and in monochromatic printing, the transfer member shifting mechanism causes the transfer member disposed on the most downstream side to come close to the opposed image bearing member, and causes the other transfer members to come away from the opposed image bearing members.

5. The image forming device as claimed in claim 4, wherein a hue of a toner image borne on the image bearing member disposed on the most upstream side in the direction of movement is yellow.

* * * * *